US009488029B2

(12) United States Patent
Chalker et al.

(10) Patent No.: US 9,488,029 B2
(45) Date of Patent: Nov. 8, 2016

(54) SWELLABLE PACKER WITH ENHANCED SEALING CAPABILITY

(75) Inventors: Christopher J. Chalker, Stavanger Rogaland (NO); Kristian Solhaug, Stavanger (NO)

(73) Assignee: Halliburton Energy Services, Inc., Carrollton, TX (US)

( * ) Notice: Subject to any disclaimer, the term of this patent is extended or adjusted under 35 U.S.C. 154(b) by 1005 days.

(21) Appl. No.: 13/303,477

(22) Filed: Nov. 23, 2011

(65) Prior Publication Data

US 2012/0067565 A1 Mar. 22, 2012

Related U.S. Application Data

(62) Division of application No. 12/016,600, filed on Jan. 18, 2008, now Pat. No. 9,303,483.

(30) Foreign Application Priority Data

Feb. 6, 2007 (WO) ..... PCT/US07/61703

(51) Int. Cl.
*E21B 33/12* (2006.01)
*E21B 33/13* (2006.01)

(52) U.S. Cl.
CPC ..... *E21B 33/1208* (2013.01); *E21B 33/13* (2013.01); *Y10T 29/49826* (2015.01)

(58) Field of Classification Search
CPC ..... E21B 33/12; E21B 33/1208; E21B 33/13
USPC ..... 166/387, 118, 119, 137, 195, 196
See application file for complete search history.

(56) References Cited

U.S. PATENT DOCUMENTS 148,387 A 3/1874 Squires
1,536,348 A 5/1925 Mack
(Continued)

FOREIGN PATENT DOCUMENTS

CN 1452686 A 10/2003
GB 2091318 A 7/1982
(Continued)

OTHER PUBLICATIONS

Protech Centerform Integral Bow Spring Centralizer webpage, 2006, 3 pages.
(Continued)

*Primary Examiner* — Brad Harcourt
(74) *Attorney, Agent, or Firm* — Locke Lord LLP; Peter Fallon; Daniel J. Fiorello

(57) ABSTRACT

A swellable packer with enhanced sealing capability. A packer assembly includes multiple seal elements, each seal element being swellable downhole, each seal element having at least one face inclined relative to a longitudinal axis of the assembly, and the inclined faces of adjacent seal elements contacting each other. A method of constructing a packer assembly having a desired differential pressure sealing capability includes: providing a base pipe and multiple seal elements, each seal element being swellable in a downhole environment, and each seal element having a predetermined differential pressure sealing capability less than the desired sealing capability; and after the desired sealing capability is determined, installing a selected number of the seal elements on the base pipe, so that the combined predetermined differential pressure sealing capabilities of the installed seal elements is at least as great as the desired sealing capability.

16 Claims, 6 Drawing Sheets

(56) References Cited

U.S. PATENT DOCUMENTS 1,736,254 A 11/1929 Davis
2,144,026 A 1/1939 Park
2,242,166 A 5/1941 Bennett
2,253,092 A 8/1941 Pranger
2,275,936 A 3/1942 Baker
2,602,516 A 7/1952 Gray
2,762,437 A 9/1956 Egan et al.
2,809,654 A 10/1957 Kraft
2,814,947 A 12/1957 Stegemeier et al.
2,828,823 A 4/1958 Mounce
2,830,540 A 4/1958 Vincent
2,849,070 A 8/1958 Maly
2,942,666 A 6/1960 True et al.
2,945,541 A 6/1960 Maly et al.
2,946,541 A 7/1960 Maly
2,981,332 A 4/1961 Miller et al.
2,981,333 A 4/1961 Miller et al.
3,099,318 A 7/1963 Miller et al.
3,385,367 A 5/1968 Kollsman
3,477,506 A 11/1969 Malone
3,776,561 A 12/1973 Haney
3,845,818 A 11/1974 Deaton
3,899,631 A 8/1975 Clark
3,918,523 A 11/1975 Stuber
3,933,203 A 1/1976 Evans
4,042,023 A 8/1977 Fox
4,137,970 A 2/1979 Laflin et al.
4,182,677 A 1/1980 Bocard et al.
4,202,087 A 5/1980 Wilderman
4,234,197 A 11/1980 Amancharla
4,240,800 A 12/1980 Fischer
4,287,952 A 9/1981 Erbstoesser
4,307,204 A 12/1981 Vidal
4,375,240 A 3/1983 Baugh et al.
4,444,403 A 4/1984 Morris
4,491,186 A 1/1985 Alder
4,558,875 A 12/1985 Yamaji et al.
4,633,950 A 1/1987 Delhommer et al.
4,635,726 A 1/1987 Walker
4,813,218 A 3/1989 Claesson
4,862,967 A 9/1989 Harris
4,936,386 A 6/1990 Colangelo
4,971,152 A 11/1990 Koster et al.
4,974,674 A 12/1990 Wells
4,998,585 A 3/1991 Newcomer et al.
5,035,286 A 7/1991 Fitzgibbon, Jr.
5,091,471 A 2/1992 Graves et al.
5,180,704 A 1/1993 Reindl et al.
5,195,583 A 3/1993 Toon et al.
5,217,071 A 6/1993 Ferry et al.
5,273,066 A 12/1993 Graham
5,327,962 A 7/1994 Head
5,333,684 A 8/1994 Walter et al.
5,337,808 A 8/1994 Graham
5,337,821 A 8/1994 Peterson
5,413,170 A 5/1995 Moore
5,423,383 A 6/1995 Pringle
5,425,420 A 6/1995 Pringle
5,433,269 A 7/1995 Hendrickson
5,435,393 A 7/1995 Brekke et al.
5,465,793 A 11/1995 Pringle
5,488,992 A 2/1996 Pringle
5,523,357 A 6/1996 Peterson
5,533,570 A 7/1996 Streich et al.
5,673,751 A 10/1997 Head et al.
5,718,287 A 2/1998 Streich et al.
5,730,223 A 3/1998 Restarick
5,803,179 A 9/1998 Echols et al.
5,876,042 A 3/1999 Graf et al.
5,896,928 A 4/1999 Coon
5,906,238 A 5/1999 Carmody et al.
5,944,322 A 8/1999 Coff et al.
6,009,951 A 1/2000 Coronado et al.
6,112,815 A 9/2000 Boe et al.
6,112,817 A 9/2000 Voll et al.
6,135,210 A 10/2000 Rivas
6,173,788 B1 1/2001 Lembcke et al.
6,227,299 B1 5/2001 Dennistoun
6,253,861 B1 7/2001 Carmichael et al.
6,305,470 B1 10/2001 Woie
6,318,729 B1 11/2001 Pitts, Jr. et al.
6,325,144 B1 12/2001 Turley et al.
6,343,651 B1 2/2002 Bixenman
6,351,985 B1 3/2002 Bedwell
6,354,372 B1 3/2002 Carisella et al.
6,354,378 B1 3/2002 Patel
6,367,845 B1 4/2002 Otten et al.
6,371,210 B1 4/2002 Bode et al.
6,390,199 B1 5/2002 Heijnen
6,431,282 B1 8/2002 Bosma et al.
6,478,091 B1 11/2002 Gano
6,505,682 B2 1/2003 Brockman
6,516,888 B1 2/2003 Gunnarson et al.
6,575,251 B2 6/2003 Watson et al.
6,581,682 B1 6/2003 Parent et al.
6,622,794 B2 9/2003 Zisk, Jr.
6,644,412 B2 11/2003 Bode
6,679,324 B2 1/2004 Den Boer et al.
6,695,067 B2 2/2004 Johnson et al.
6,705,615 B2 3/2004 Milberger et al.
6,719,051 B2 4/2004 Hailey, Jr. et al.
6,786,285 B2 9/2004 Johnson et al.
6,817,416 B2 11/2004 Wilson et al.
6,834,725 B2 12/2004 Whanger et al.
6,840,325 B2 1/2005 Stephenson
6,848,505 B2 2/2005 Richard et al.
6,851,560 B2 2/2005 Reig et al.
6,857,475 B2 2/2005 Johnson
6,857,476 B2 2/2005 Richards
6,883,613 B2 4/2005 Bode
6,886,634 B2 5/2005 Richards
6,907,937 B2 6/2005 Whanger et al.
6,935,432 B2 8/2005 Nguyen
6,938,689 B2 9/2005 Coronado
6,957,703 B2 10/2005 Trott et al.
6,988,557 B2 1/2006 Whanger
7,013,979 B2 3/2006 Richard
7,059,401 B2 6/2006 Bode et al.
7,059,415 B2 6/2006 Bosma et al.
7,063,162 B2 6/2006 Daling et al.
7,070,001 B2 7/2006 Whanger et al.
7,083,162 B2 8/2006 He
7,096,945 B2 8/2006 Richards
7,100,686 B2 9/2006 Wittrisch
7,108,083 B2 9/2006 Simonds et al.
7,121,352 B2 10/2006 Cook et al.
7,124,831 B2 10/2006 Turley et al.
7,143,832 B2 12/2006 Freyer
7,152,684 B2 12/2006 Harrall et al.
7,185,706 B2 3/2007 Freyer
7,191,833 B2 3/2007 Richards
7,195,730 B2 3/2007 Calderoni et al.
7,207,386 B2 4/2007 Brannon
7,215,594 B2 5/2007 Im
7,222,676 B2 5/2007 Patel et al.
7,228,915 B2 6/2007 Thomson
7,234,533 B2 6/2007 Gambier
7,252,153 B2 8/2007 Hejl
7,290,606 B2 11/2007 Coronado
7,296,597 B1 11/2007 Freyer
7,367,395 B2 5/2008 Vidrine
7,409,999 B2 8/2008 Henriksen et al.
7,419,002 B2 9/2008 Dybevik et al.
7,422,071 B2 9/2008 Wilkie et al.
7,426,962 B2 9/2008 Moen
7,455,104 B2 11/2008 Duhon
7,469,743 B2 12/2008 Richards
7,493,947 B2 2/2009 Ross
7,537,056 B2 5/2009 MacDougall
7,665,537 B2 2/2010 Patel et al.
7,690,437 B2 4/2010 Guillot et al.
7,708,068 B2 5/2010 Hailey, Jr.
7,802,621 B2 9/2010 Richards et al.
7,866,383 B2 1/2011 Dusterhoft et al.

(56) References Cited

U.S. PATENT DOCUMENTS

| | | | |
|---|---|---|---|
| 7,866,408 | B2 | 1/2011 | Allison et al. |
| 8,006,773 | B2 | 8/2011 | Courville et al. |
| 8,047,928 | B2 | 11/2011 | Bittner |
| 2002/0056553 | A1 | 5/2002 | Duhon et al. |
| 2003/0173092 | A1 | 9/2003 | Wilson et al. |
| 2004/0007829 | A1 | 1/2004 | Ross |
| 2004/0020662 | A1 | 2/2004 | Freyer |
| 2004/0035590 | A1 | 2/2004 | Richard |
| 2004/0055760 | A1 | 3/2004 | Nguyen |
| 2004/0060706 | A1 | 4/2004 | Stephenson |
| 2004/0108107 | A1 | 6/2004 | Wittrisch |
| 2004/0112609 | A1 | 6/2004 | Whanger et al. |
| 2004/0144544 | A1 | 7/2004 | Freyer |
| 2004/0194971 | A1 | 10/2004 | Thomson |
| 2004/0231861 | A1 | 11/2004 | Whanger et al. |
| 2004/0261990 | A1 | 12/2004 | Bosma et al. |
| 2005/0016732 | A1 | 1/2005 | Brannon et al. |
| 2005/0092485 | A1 | 5/2005 | Brezinski et al. |
| 2005/0103497 | A1 | 5/2005 | Gondouin |
| 2005/0110217 | A1 | 5/2005 | Wood et al. |
| 2005/0150661 | A1 | 7/2005 | Kenison et al. |
| 2005/0171248 | A1 | 8/2005 | Li et al. |
| 2005/0173130 | A1 | 8/2005 | Richard |
| 2005/0199401 | A1 | 9/2005 | Patel et al. |
| 2006/0027377 | A1 | 2/2006 | Schoonderbeek et al. |
| 2006/0076150 | A1 | 4/2006 | Coronado et al. |
| 2006/0185849 | A1 | 8/2006 | Edwards |
| 2006/0272806 | A1 | 12/2006 | Wilkie et al. |
| 2006/0278391 | A1 | 12/2006 | Li et al. |
| 2007/0012436 | A1 | 1/2007 | Freyer |
| 2007/0131414 | A1 | 6/2007 | Calderoni |
| 2007/0151724 | A1 | 7/2007 | Ohmer et al. |
| 2007/0205002 | A1 | 9/2007 | Baaijens et al. |
| 2007/0221387 | A1 | 9/2007 | Levy |
| 2007/0246212 | A1 | 10/2007 | Richards |
| 2007/0246213 | A1 | 10/2007 | Hailey, Jr. |
| 2007/0246225 | A1 | 10/2007 | Hailey et al. |
| 2007/0246407 | A1 | 10/2007 | Richards |
| 2007/0257405 | A1 | 11/2007 | Freyer |
| 2008/0023205 | A1 | 1/2008 | Craster et al. |
| 2008/0035330 | A1 | 2/2008 | Richards |
| 2008/0041580 | A1 | 2/2008 | Freyer |
| 2008/0041581 | A1 | 2/2008 | Richards |
| 2008/0041582 | A1 | 2/2008 | Saetre |
| 2008/0041588 | A1 | 2/2008 | Richards |
| 2008/0066912 | A1 | 3/2008 | Freyer |
| 2008/0078561 | A1 | 4/2008 | Chalker |
| 2008/0093086 | A1 | 4/2008 | Courville et al. |
| 2008/0110626 | A1 | 5/2008 | Allison et al. |
| 2008/0135260 | A1 | 6/2008 | Berzin et al. |
| 2008/0185158 | A1 | 8/2008 | Chalker et al. |
| 2008/0308283 | A1 | 12/2008 | Freyer |
| 2009/0044957 | A1 | 2/2009 | Clayton et al. |
| 2009/0133869 | A1 | 5/2009 | Clem |
| 2009/0139707 | A1 | 6/2009 | Berzin et al. |
| 2009/0179383 | A1 | 7/2009 | Koloy et al. |
| 2009/0211770 | A1 | 8/2009 | Nutley et al. |
| 2009/0218107 | A1 | 9/2009 | Chauffe |
| 2010/0051294 | A1 | 3/2010 | Nutley et al. |
| 2010/0065284 | A1 | 3/2010 | Freyer |
| 2010/0139930 | A1 | 6/2010 | Patel et al. |
| 2010/0155064 | A1 | 6/2010 | Nutley et al. |
| 2010/0212883 | A1 | 8/2010 | Emerson et al. |
| 2011/0083861 | A1 | 4/2011 | Allison et al. |

FOREIGN PATENT DOCUMENTS

| | | | |
|---|---|---|---|
| GB | 2314866 | A | 1/1998 |
| GB | 2341405 | A | 3/2000 |
| GB | 2355740 | A | 5/2001 |
| GB | 2356879 | A | 6/2001 |
| GB | 2371578 | A | 7/2002 |
| GB | 2396869 | A | 7/2004 |
| GB | 2406593 | A | 4/2005 |
| GB | 2416796 | A | 2/2006 |
| GB | 2417270 | A | 2/2006 |
| GB | 2417271 | A | 2/2006 |
| GB | 2417272 | A | 2/2006 |
| GB | 2428263 | A | 1/2007 |
| GB | 2428264 | A | 1/2007 |
| JP | 04-363499 | | 12/1992 |
| JP | 09-151686 | | 6/1997 |
| JP | 2000-064764 | | 2/2000 |
| RU | 2157440 | C2 | 10/2000 |
| WO | 0220941 | A1 | 3/2002 |
| WO | 02059452 | A1 | 8/2002 |
| WO | 02075110 | A1 | 9/2002 |
| WO | 02090714 | A1 | 11/2002 |
| WO | 03008756 | A1 | 1/2003 |
| WO | 2004015238 | A1 | 2/2004 |
| WO | 2004057715 | A2 | 6/2004 |
| WO | 2005090741 | A1 | 9/2005 |
| WO | 2005116394 | A1 | 12/2005 |
| WO | 2006003112 | A1 | 1/2006 |
| WO | 2006003113 | A1 | 1/2006 |
| WO | 2006118470 | A1 | 11/2006 |
| WO | 2008024645 | A2 | 2/2008 |
| WO | 2008024645 | A3 | 2/2008 |
| WO | 2008033115 | A1 | 3/2008 |
| WO | 2008060297 | A2 | 5/2008 |
| WO | 2009048822 | A2 | 4/2009 |
| WO | 2009048823 | A2 | 4/2009 |
| WO | 2009067021 | A2 | 5/2009 |

OTHER PUBLICATIONS

Protech Centerform Case Histories webpage, 2006, 3 pages.

Protech Centerform Carbon Fiber Composite Centralizers webpage, 2006, 2 pages.

International Search Report and Written Opinion issued Jun. 27, 2008, for International Patent Application Serial No. PCT/US08/50371, 7 pages.

International Search Report and Written Opinion issued Mar. 21, 2008, for International Patent Application Serial No. PCT/US07/61703, 7 pages.

Salamy, S.P., Al-Mubarak, H.K., Hembling, D.E., and Al-Ghamdi, M.S., Deployed Smart Technologies Enablers for Improving Well Performance in Tight Reservoirs, SPE 99281, Apr. 11-13, 2006, 6 pages, Amsterdam.

Jennings, Iain, Enhancing Production Using Solid Expandable Tubulars in Workover Campaigns, SPE 107624, Apr. 16-18, 2007, 5 pages, Denver, Colorado.

Kleverlaan, M., Van Noort, R. H., Jones, I., Deployment of Swelling Elastomer Packers in Shell E&P, SPE 92346, Feb. 23-25, 2005, 5 pages, Amsterdam.

Halliburton Swellpacker® Cable System Product Brochure, 2008, 2 pages.

International Preliminary Report on Patentability with Written Opinion issued Aug. 20, 2009, for International Patent Application No. PCT/US07/617063, 7 pages.

Office Action issued Oct. 28, 2009, for U.S. Appl. No. 11/875,779, 18 pages.

Final Office Action issued Nov. 5, 2010, for U.S. Appl. No. 12/016,600, 10 pages.

Office Action issued Nov. 9, 2010, for U.S. Appl. No. 12/615,335, 17 pages.

Chinese Office Action issued Jul. 6, 2011 for CN Patent Application No. 20068055799.8, 7 pages.

Notice of Opposition issued for GB Patent No. 1570151 dated Apr. 14, 2008, 27 pages.

Response dated Nov. 21, 2008 to EPC Notice of Opposition for European Patent No. 1570151 filed Apr. 14, 2008 by Swellfix B.V., 18 pages.

Examiner's Answer issued Aug. 26, 2010 for U.S. Appl. No. 10/538,330, 10 pages.

Australian Examination Report issued Aug. 23, 2006, for AU application serial No. 2003303119, 2 pages.

Office Action issued Sep. 10, 2007 for U.S. Appl. No. 10/538,330, 15 pages.

(56) References Cited

OTHER PUBLICATIONS

Office Action issued Mar. 11, 2008 for U.S. Appl. No. 10/538,330, 9 pages.
Office Action issued Aug. 7, 2008 for U.S. Appl. No. 10/538,330, 10 pages.
Office Action issued Jan. 28, 2009 for U.S. Appl. No. 10/538,330, 9 pages.
Office Action issued Jul. 16, 2009 for U.S. Appl. No. 10/538,330, 8 pages.
Office Action issued Jan. 21, 2010 for U.S. Appl. No. 10/538,330, 14 pages.
European Examination Report issued Feb. 15, 2006 for EP Application No. 03813035.7-2315, 3 pages.
International Preliminary Report on Patentability with Written Opinion issued Mar. 26, 2009, for PCT Patent Application No. PCT/US06/35052, 5 pages.
Norwegian Examination and Search Report issued Jun. 11, 2003 for NO Application No. 2002 5911, 3 pages.
Office Action issued Sep. 10, 2010 for U.S. Appl. No. 12/624,282, 15 pages.
Office Action issued Jan. 20, 2011 for U.S. Appl. No. 12/624,282, 15 pages.
Office Action issued Feb. 9, 2012 for U.S. Appl. No. 12/348,395, 14 pages.
International Search Report and Written Opinion issued Mar. 21, 2008 for International Application No. PCT/US07/61703, 7 pages.
Office Action issued Jun. 22, 2009 for U.S. Appl. No. 11/852,295, 16 pages.
Office Action issued Dec. 3, 2009, for U.S. Appl. No. 11/852,295, 10 pages.
Russian Office Action issued Jan. 11, 2010, for Russian Patent Application Serial No. 2009113625, 2 pages.
English Translation of Russian Office Action issued Jan. 11, 2010, for Russian Patent Application Serial No. 2009113625, 2 pages.
Canadian Office Action issued Feb. 11, 2011 for CA Patent Application No. 2,677,254, 2 pages.
Office Action issued Jun. 16, 2010, for U.S. Appl. No. 12/016,600, 47 pages.
Office Action issued Nov. 5, 2010, for U.S. Appl. No. 12/016,600, 10 pages.
Office Action issued Mar. 16, 2011, for U.S. Appl. No. 12/016,600, 8 pages.
Office Action issued Jun. 30, 2011, for U.S. Appl. No. 12/016,600, 13 pages.
Specification and drawings for U.S. Appl. No. 12/410,042, filed Mar. 24, 2009, 38 pages.
International Preliminary Report on Patentability issued Mar. 26, 2009, for International Patent Application Serial No. PCT/US07/35052, 5 pages.
International Preliminary Report on Patentability issued May 28, 2009, for International Patent Application Serial No. PCT/US06/60926, 8 pages.
Office Action issued Jun. 22, 2009, for U.S. Appl. No. 11/852,295, 16 pages.
Office Action issued Dec. 10, 2009, for U.S. Appl. No. 11/939,968, 27 pages.
Advisory Action issued Sep. 14, 2012 for U.S. Appl. No. 12/016,600, 7 pages.
Weatherford; "Application Answers", product brochure, dated 2005, 4 pages.
Office Action issued Jun. 14, 2006 for U.S. Appl. No. 10/477,440, 10 pages.
UK Examination Report issued Jul. 19, 2007 for GB Patent Application No. 0707831.4, 3 pages.
Office Action issued Jul. 3, 2012 for U.S. Appl. No. 12/016,600, 13 pages.
Office Action issued Jul. 5, 2012 for U.S. Appl. No. 12/348,395, 18 pages.
EPO Communication dated Feb. 8, 2007, containing a Letter from the Opponent dated Jan. 31, 2007, for European Patent Application No. EP 01958642.9, 2 pages.
EPO Communication of a Notice of Opposition dated Dec. 14, 2006, for European Patent Application No. EP 01958642.9, 16 pages.
International Search Report issued Nov. 13, 2001, for International Patent Application No. PCT/NO01/00275, 3 pages.
Chloroprene, Kirk-Othmer Encyclopedia of Chemical Technology, 1993, title and copyright pages and p. 70, vol. 6, John Wiley & Sons publisher, New York.
The Concise Oxford Dictionary, undated, title page and pp. 148-149, 360-361, 740-741, 7th Edition, Clarendon Press, Oxford.
European Search Report issued May 18, 2006, for European Patent Application No. EP 06075453.8, 5 pages.
International Search Report and Written Opinion issued Jun. 17, 2008, for International Patent Application Serial No. PCT/US06/60926, 6 pages.
International Search Report and written Opinion issued Feb. 21, 2007, for International Patent Application Serial No. PCT/US06/35052, 8 pages.
EasyWell SwellPacker Cable presentation, 2006, 2 pages.
U.S. Appl. No. 12/410,042, flied Mar. 24, 2009, 38 pages.
Office Action issued Nov. 6, 2012 for U.S. Appl. No. 12/348,395, 16 pages.
Office Action issued Nov. 6, 2012 for U.S. Appl. No. 12/016,600, 13 pages.
Office Action issued Apr. 9, 2013 for U.S. Appl. No. 12/348,395, 14 pages.
Mexican Office Action issued Nov. 13, 2012 for MX Patent Application No. MX/a/2009/008348, 4 pages.
Society of Petroleum Engineers; "Perforation Friction Pressure of Fracturing Fluid Slurries", SPE 25891, dated Apr. 12-14, 1993, 14 pages.
Society of Petroleum Engineers; "Means for Passive Inflow Control Upon Gas Breakthrough", SPE 102208, dated Sep. 24-27, 2006, 6 pages.
International Search Report issued Aug. 28, 2002 for PCT Patent Application No. PCT/NO02/00158, 2 pages.
Australian Examination Report issued Nov. 29, 2012 for Australian Patent Application No. 2007346700, 4 pages.
Office Action issued Jul. 20, 2009, for U.S. Appl. No. 11/596,571, 19 pages.
Examiner's Answer issued Aug. 21, 2009, for U.S. Appl. No. 11/466,022, 8 pages.
Office Action issued Oct. 27, 2009, for U.S. Appl. No. 11/407,848, 10 pages.
Office Action issued Nov. 12, 2009, for U.S. Appl. No. 11/409,734, 17 pages.
Office Action issued Apr. 15, 2010, for U.S. Appl. No. 11/852,295, 7 pages.
Examiner's Answer issued Mar. 31, 2010, for AU Patent Application Serial No. 2007315792, 1 page.
Office Action issued Mar. 11, 2010, for U.S. Appl. No. 11/596,571, 17 pages.
Office Action issued Mar. 24, 2010, for U.S. Appl. No. 11/958,466, 48 pages.
Office Action issued Apr. 14, 2009 for U.S. Appl. No. 111409,734, 9 pages.
Office Action issued Jun. 7, 2010 for U.S. Appl. No. 11/939,968, 17 pages.
Advisory Action issued Aug. 13, 2010 for U.S. Appl. No. 11/939,968, 3 pages.
International Search Report and Written Opinion issued Oct. 14, 2010 for PCT Patent Application No. PCT/US10/027561, 9 pages.
Examiner's Answer issued Jun. 6, 2013 for U.S. Appl. No. 12/016,600, 5 pages.
Office Action issued Jun. 8, 2011 for U.S. Appl. No. 12/972,438, 19 pages.
Office Action issued Oct. 19, 2011 for U.S. Appl. No. 12/972,438, 15 pages.
Office Action issued Mar. 15, 2011 for U.S. Appl. No. 12/410,042, 26 pages.

(56) References Cited

OTHER PUBLICATIONS

International Preliminary Report on Patentability issued Oct. 6, 2011 for PCT Patent Application No. PCT/US10/027561, 6 pages.
Office Action issued Dec. 19, 2011 for U.S. Appl. No. 13/197,973, 29 pages.
Norwegian Search Report issued Jun. 6, 2003 for NO Patent Application No. 2202 5911, 1 page.
TAM International, Freecap™ Swellable Elastomer Packers brochure, undated, 1 page.
TAM International, Freecap™ Swellable Elastomer Packers webpage, www.tamintl.com/pages/FREECAP/FreeCap1.html retrieved Jul. 29, 2006, 1 page.
Office Action issued Dec. 1, 2008 for U.S. Appl. No. 11/407,848, 21 pages.
International Search Report and Written Opinion issued Feb. 19, 2009 for PCT Patent Application No. PCT/US08/87318, 7 pages.
International Search Report and Written Opinion issued Feb. 27, 2009 for PCT Patent Application No. PCT/IB07/04287, 6 pages.
International Preliminary Report on Patentability issued Mar. 5, 2009 for PCT Patent Application No. PCT/US07/75743, 5 pages.
Chinese Office Action issued Feb. 27, 2009 for CN Patent Application No. 200580016654.2, 6 pages.
Office Action issued Mar. 16, 2009 for U.S. Appl. No. 11/671,319, 47 pages.
Office Action issued Nov. 3, 2011 for U.S. Appl. No. 11/958,466, 11 pages.
Office Action issued Apr. 11, 2011 for U.S. Appl. No. 11/958,466, 9 pages.
International Search Report and Written Opinion issued Aug. 17, 2010 for PCT Patent Application Serial No. PCT/US06/60094, 12 pages.
Office Action issued Jan. 14, 2008 for U.S. Appl. No. 11/407,704, 23 pages.
Office Action issued Dec. 17, 2008 for U.S. Appl. No. 11/407,704, 17 pages.
Office Action issued Apr. 1, 2009 for U.S. Appl. No. 11/407,704, 11 pages.
International Search Report and Written Opinion issued Aug. 27, 2008, for International Patent Application Serial No. PCT/US07/66991, 7 pages.
International Search Report and Written Opinion issued Feb. 11, 2008, for International Patent Application Serial No. PCT/US07/75743, 8 pages.
Office Action issued Oct. 20, 2008, for U.S. Appl. No. 11/409,734, 30 pages.
International Preliminary Report on Patentability issued Oct. 22, 2008, for International Patent Application Serial No. PCT/US07/66991, 5 pages.
Search Report issued Jul. 19, 2007, for GB Patent Application Serial No. 0707631.4, 3 pages.
Examination Report issued Aug. 23, 2006, for Australian Patent Application Serial No. 2003303119, 2 pages.
Office Action issued Jan. 11, 2008, for U.S. Appl. No. 11/668,024, 18 pages.
Office Action issued Jul. 10, 2008, for U.S. Appl. No. 11/668,024, 7 pages.
Office Action issued Aug. 26, 2008, for U.S. Appl. No. 11/466,022, 8 pages.
Extended European Search Report issued Jul. 14, 2015 for European Patent Application No. 07717568.5.
Examiner's Answer issued Jul. 28, 2009 for U.S. Appl. No. 11/407,848, 20 pages.
International Preliminary Report on Patentability issued Aug. 6, 2009 for PCT Patent Application No. PCT/IB2007/004287, 5 pages.
Office Action issued Nov. 26, 2010, for U.S. Appl. No. 11/958,466, 14 pages.
Office Action issued Jul. 28, 2010, for U.S. Appl. No. 11/958,466, 13 pages.
Wikipedia, Drag (physics), dated Jul. 8, 2010, 9 pages.

SWELLABLE PACKER WITH ENHANCED SEALING CAPABILITY

CROSS-REFERENCE TO RELATED APPLICATION

This application is a division of prior application Ser. No. 12/016,600 filed on 18 Jan. 2008, and claims the benefit under 35 USC §119 of the filing date of International Application No. PCT/US07/61703, filed on Jan. 6, 2007. The entire disclosures of these prior applications are incorporated herein by this reference.

BACKGROUND

The present invention relates generally to equipment utilized and operations performed in conjunction with a subterranean well and, in an embodiment described herein, more particularly provides a swellable packer with enhanced sealing capability.

Conventional swellable packers are constructed by placing a swellable seal material on a base pipe. Additional elements, such as support rings, may be included in the packer. The seal material forms a seal element, the purpose of which is to seal off an annular passage in a well.

A differential pressure sealing capability of the packer is determined by many factors. Two significant factors are the volume of the seal material, and the length of the seal element along the base pipe. Since inner and outer diameters of the seal element are typically determined by physical constraints of a wellbore and desired internal flow area, the length of the seal element is generally varied when needed to produce different differential pressure ratings for swellable packers.

Unfortunately, this means that different length base pipes and seal elements need to be manufactured, inventoried, shipped to various locations, etc. This results in reduced profits and reduced convenience.

Therefore, it may be seen that improvements are needed in the art of constructing swellable packers.

SUMMARY

In carrying out the principles of the present invention, a packer assembly and associated method are provided which solve at least one problem in the art. One example is described below in which the differential pressure sealing capability of a packer is varied by varying a number of swellable seal elements in the packer, instead of by varying the length of any particular seal element. Another example is described below in which the pressure sealing capability of a packer is enhanced due to configurations of mating surfaces and faces of the seal elements and support rings surrounding the seal elements.

In one aspect of the invention, a method of constructing a packer assembly having a desired differential pressure sealing capability is provided. The method includes the steps of providing a base pipe and providing multiple seal elements. Each of the seal elements is swellable in a downhole environment, and each of the seal elements has a predetermined differential pressure sealing capability less than the desired differential pressure sealing capability of the packer assembly.

After the desired differential pressure sealing capability of the packer assembly is determined, a selected number of the seal elements is installed on the base pipe. As a result, the combined predetermined differential pressure sealing capabilities of the installed seal elements is at least as great as the desired differential pressure sealing capability of the packer assembly.

In another aspect of the invention, a packer assembly is provided. The packer assembly includes multiple seal elements. Each seal element is swellable in a downhole environment, and each seal element has at least one face inclined relative to a longitudinal axis of the packer assembly. The inclined faces of adjacent seal elements contact each other.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
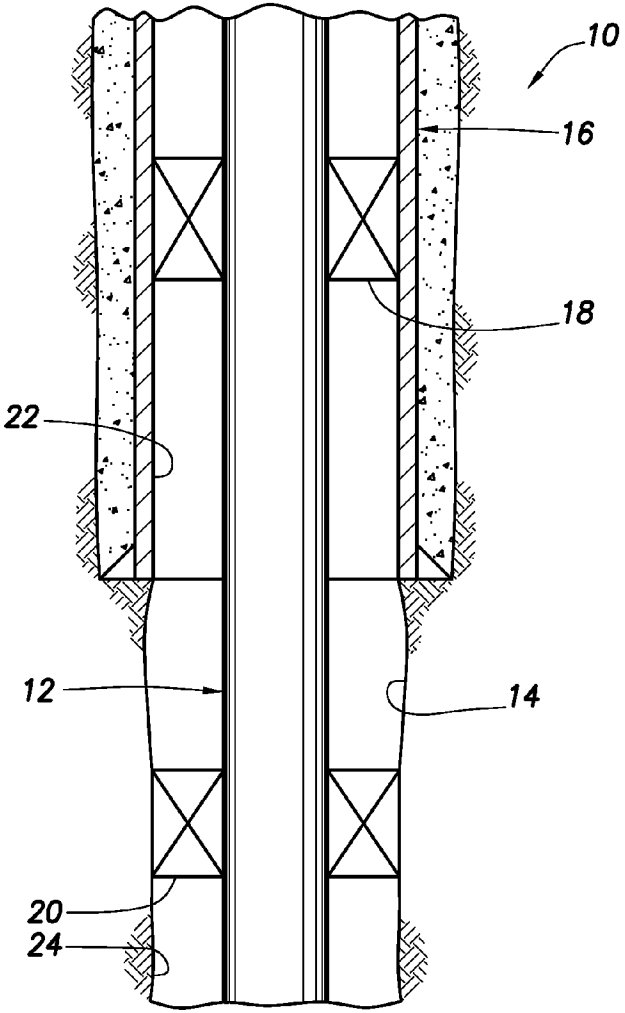
FIG. 1 is a schematic partially cross-sectional view of a well system and associated method embodying principles of the present invention.

Representatively illustrated in FIG. 1 is a well system 10 which embodies principles of the present invention. In the well system 10, a tubular string 12 (such as a production tubing string, liner string, etc.) has been installed in a wellbore 14. The wellbore 14 may be fully or partially cased (as depicted with casing string 16 in an upper portion of FIG. 1), and/or the wellbore may be fully or partially uncased (as depicted in a lower portion of FIG. 1).

An annular barrier is formed between the tubular string 12 and the casing string 16 by means of a swellable packer 18.

Another annular barrier is formed between the tubular string 12 and the uncased wellbore 14 by means of another swellable packer 20.

However, it should be clearly understood that the packers 18, 20 are merely two examples of practical uses of the principles of the invention. Other types of packers may be constructed, and other types of annular barriers may be formed, without departing from the principles of the invention.

For example, an annular barrier could be formed in conjunction with a tubing, liner or casing hanger, a packer may or may not include an anchoring device for securing a tubular string, a bridge plug or other type of plug may include an annular barrier, etc. Thus, the invention is not limited in any manner to the details of the well system 10 described herein.

Each of the packers 18, 20 preferably includes a seal assembly with a swellable seal material which swells when contacted by an appropriate fluid. The term "swell" and similar terms (such as "swellable") are used herein to indicate an increase in volume of a seal material. Typically, this increase in volume is due to incorporation of molecular components of the fluid into the seal material itself, but other swelling mechanisms or techniques may be used, if desired.

When the seal material swells in the well system 10, it expands radially outward into contact with an inner surface 22 of the casing string 16 (in the case of the packer 18), or an inner surface 24 of the wellbore 14 (in the case of the packer 20). Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal elements expands, but does not swell.

The fluid which causes swelling of the swellable material could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material could be delayed until the material is positioned downhole where a predetermined elevated temperature exists. The fluid could cause swelling of the swellable material due to passage of time.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable material which swells when contacted by any type of fluid may be used in keeping with the principles of the invention.

Figure 2:
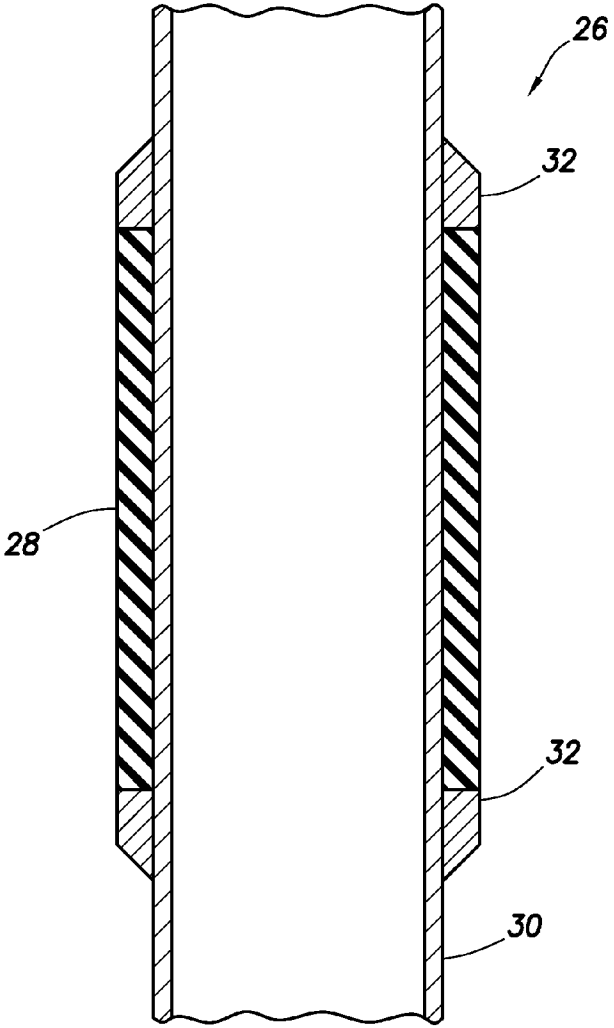
FIG. 2 is a schematic cross-sectional view of a swellable packer.

Referring additionally now to FIG. 2, a swellable packer 26 is representatively illustrated. The packer 26 includes a single seal element 28 made of a swellable material. The seal element 28 is installed on a base pipe 30.

The base pipe 30 may be provided with end connections (not shown) to permit interconnection of the base pipe in the tubular string 12, or the base pipe could be a portion of the tubular string. Support rings 32 are attached to the base pipe 30 straddling the seal element 28 to restrict longitudinal displacement of the seal element relative to the base pipe.

It will be appreciated that the differential pressure sealing capability of the packer 26 may be increased by lengthening the seal element 28, or the sealing capability may be decreased by shortening the seal element. Thus, to provide a desired sealing capability for a particular application (such as, for the packer 18 or 20 in the well system 10), a certain corresponding length of the seal element 28 will have to be provided.

Accordingly, to provide a range of sealing capabilities usable for different applications, a corresponding range of respective multiple lengths of the seal element 28 must be provided. Those skilled in the art will appreciate that the need to manufacture, inventory and distribute multiple different configurations of a well tool increases the cost and reduces the convenience of providing the well tool to the industry.

Figure 3B:
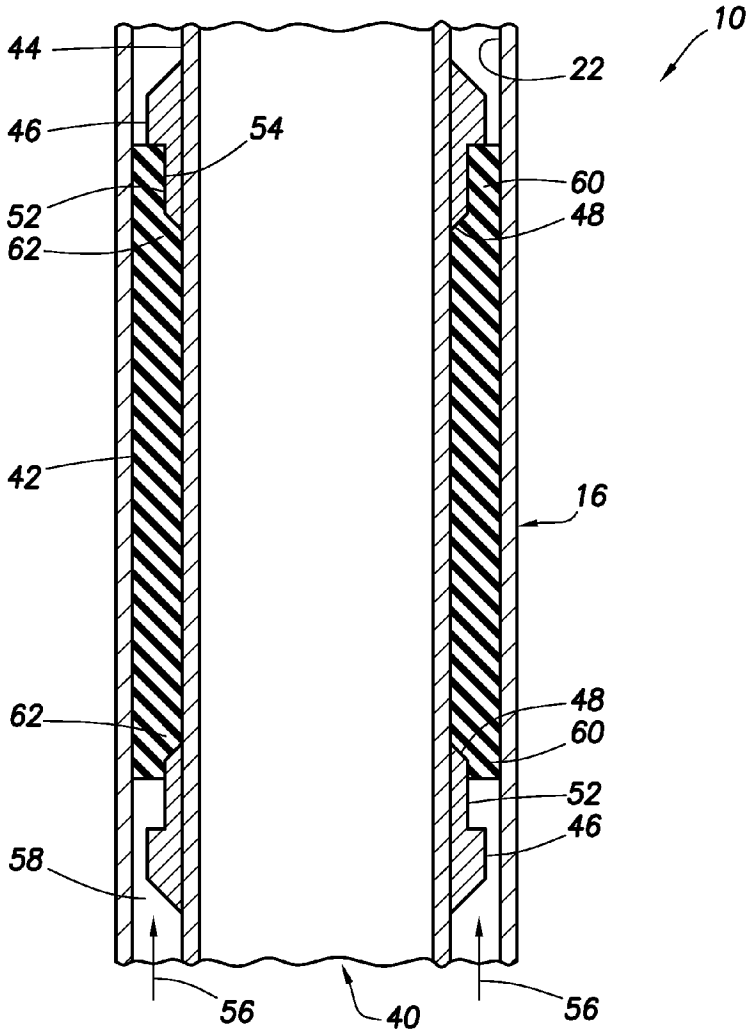
FIGS. 3A & B are schematic cross-sectional views of a swellable packer assembly embodying principles of the present invention.
Figure 3A:
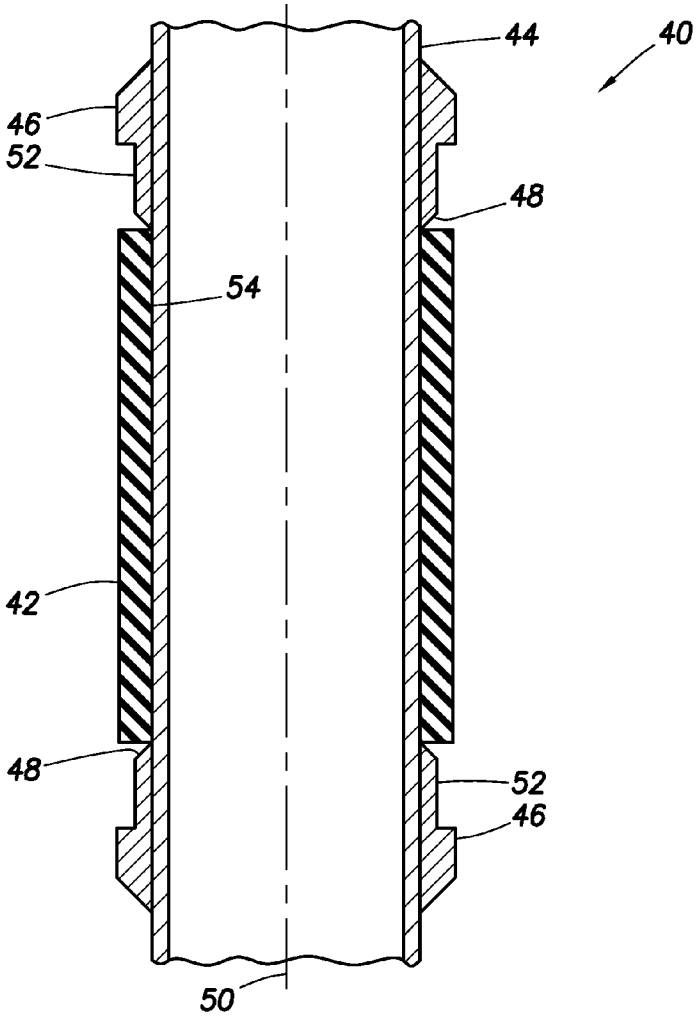

Referring additionally now to FIGS. 3A & B, a packer assembly 40 which incorporates principles of the invention is representatively illustrated. The packer assembly 40 may be used for either of the packers 18, 20 in the well system 10, or the packer assembly may be used in other well systems.

The packer assembly 40 is similar in some respects to the packer 26 described above, in that it includes a swellable seal element 42 on a base pipe 44. However, the packer assembly 40 includes features which enhance the sealing capability of the seal element 42. Specifically, the packer assembly 40 includes support rings 46 which are attached to the base pipe 44 straddling the seal element 42.

Each support ring 46 includes a conical face 48 which is inclined relative to a longitudinal axis 50 of the base pipe 44 and packer assembly 40. The face 48 biases the adjacent seal element 42 radially outward into sealing contact with a well surface (such as either of the surfaces 22, 24 in the well system 10) when the seal element swells downhole.

Each support ring 46 also includes a cylindrical outer surface 52 which is radially offset relative to a cylindrical inner surface 54 of the seal element 42. The surface 52 also biases the seal element 42 radially outward into sealing contact with a well surface when the seal element swells downhole.

In FIG. 3B the packer assembly 40 is depicted in the casing string 16 of the well system 10 after the seal element 42 has swollen. In this view it may be seen that the seal element 42 now sealingly contacts the inner surface 22 of the casing string 16.

Due to pressure 56 applied in an upward direction in an annulus 58 between the packer assembly 40 and the casing string 16, the seal element 42 volume is upwardly shifted somewhat relative to the base pipe 44.

However, the seal element 42 is prevented from displacing significantly relative to the base pipe 44 by the support rings 46. For this purpose, the support rings 46 may be attached to the base pipe 44 using techniques such as fastening, welding, bonding, threading, etc.

In this view it may also be seen that the seal element 42 is biased radially outward by the support rings 46, thereby enhancing the sealing contact between the seal element and the inner surface 22 of the casing string 16. Specifically, the seal element 42 is radially compressed by engagement between the seal element and the inclined faces 48 at regions 62, and the seal element is radially compressed by engagement between the inner surface 54 of the seal element and the outer surfaces 52 of the support rings 46 at regions 60.

This radial compression of the seal element 42 at the regions 60, 62 enhances the sealing capability of the packer assembly 40. Note that the inclined faces 48 facilitate radial displacement of the inner surface 54 outward onto the outer surfaces 52 of the support rings 46 as the seal element 42 swells downhole.

Although the seal element 42 is depicted in FIGS. 3A & B as being only a single element, multiple seal elements could be used on the base pipe 44 to enhance the sealing capability of the packer assembly 40. Furthermore, the use of multiple seal elements 42 would preferably eliminate the necessity of providing different length seal elements for respective different applications with different desired differential sealing capabilities.

Figure 5A:
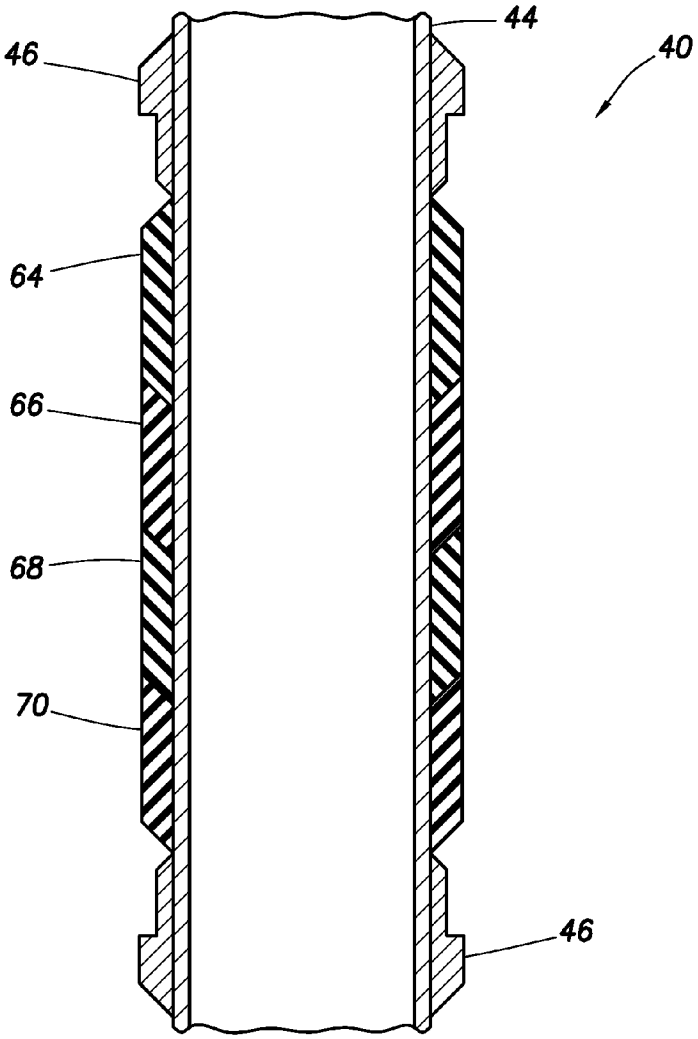
FIGS. 5A & B are schematic cross-sectional views of a second alternate construction of the swellable packer assembly.
Figure 4:
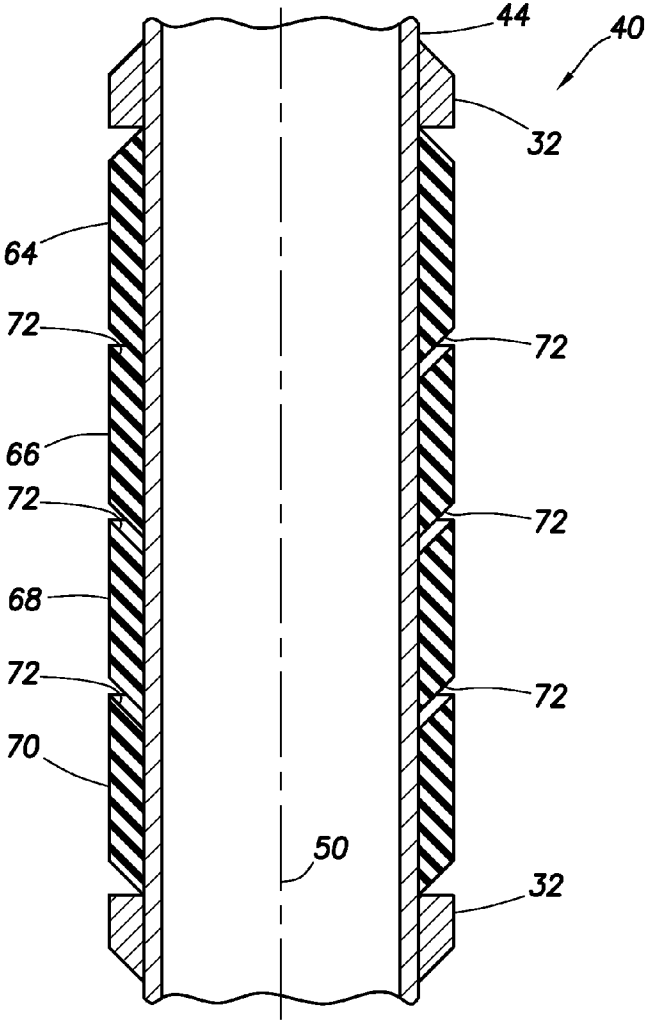
FIG. 4 is a schematic cross-sectional view of a first alternate construction of the swellable packer assembly.

Referring additionally now to FIG. 4, the packer assembly 40 is representatively illustrated in an alternate configuration in which multiple swellable seal elements 64, 66, 68, 70 are used on the base pipe 44. The seal elements 64, 66, 68, 70 are straddled by the support rings 32 attached to the base pipe 44, but the support rings 46 could be used instead (as depicted in FIG. 5A).

To provide a minimum level of differential pressure sealing capability, only the seal element 64 could be used on the base pipe 44, in which case the support rings 32 would be positioned to straddle only the seal element 64. If an increased level of sealing capability is desired, the seal element 66 could be added, and if a further increased level of sealing capability is desired, one or more additional seal elements 68, 70 could be added.

Thus, any desired differential pressure sealing capability of the packer assembly 40 may be achieved by installing a selected number of the seal elements 64, 66, 68, 70 on the base pipe 44. In this manner, the need to provide different length seal elements for respective different applications with different desired differential sealing capabilities is eliminated.

Instead, only a very few (perhaps just one) number of seal element designs need to be produced, with each having a predetermined differential sealing capability. When a desired sealing capability of the packer assembly 40 is known, then an appropriate number of the seal elements 64, 66, 68, 70 can be selected for installation on the base pipe 44.

As depicted in FIG. 4, the seal element 64 has a different shape as compared to the seal elements 66, 68, 70. It should be understood that this is not necessary in keeping with the principles of the invention.

However, preferably the seal elements 64, 66, 68, 70 have faces 72 which are inclined relative to the longitudinal axis 50, and which contact each other between adjacent seal elements. This contact exists at least when the seal elements 64, 66, 68, 70 are swollen downhole, but the inclined faces 72 could contact each other prior to the seal elements swelling (as shown in FIG. 5A). The seal elements 64, 66, 68, 70 are depicted in FIG. 4 as being longitudinally separated from each other, so that the arrangement of the inclined faces 72 can be more clearly seen.

Figure 5B:
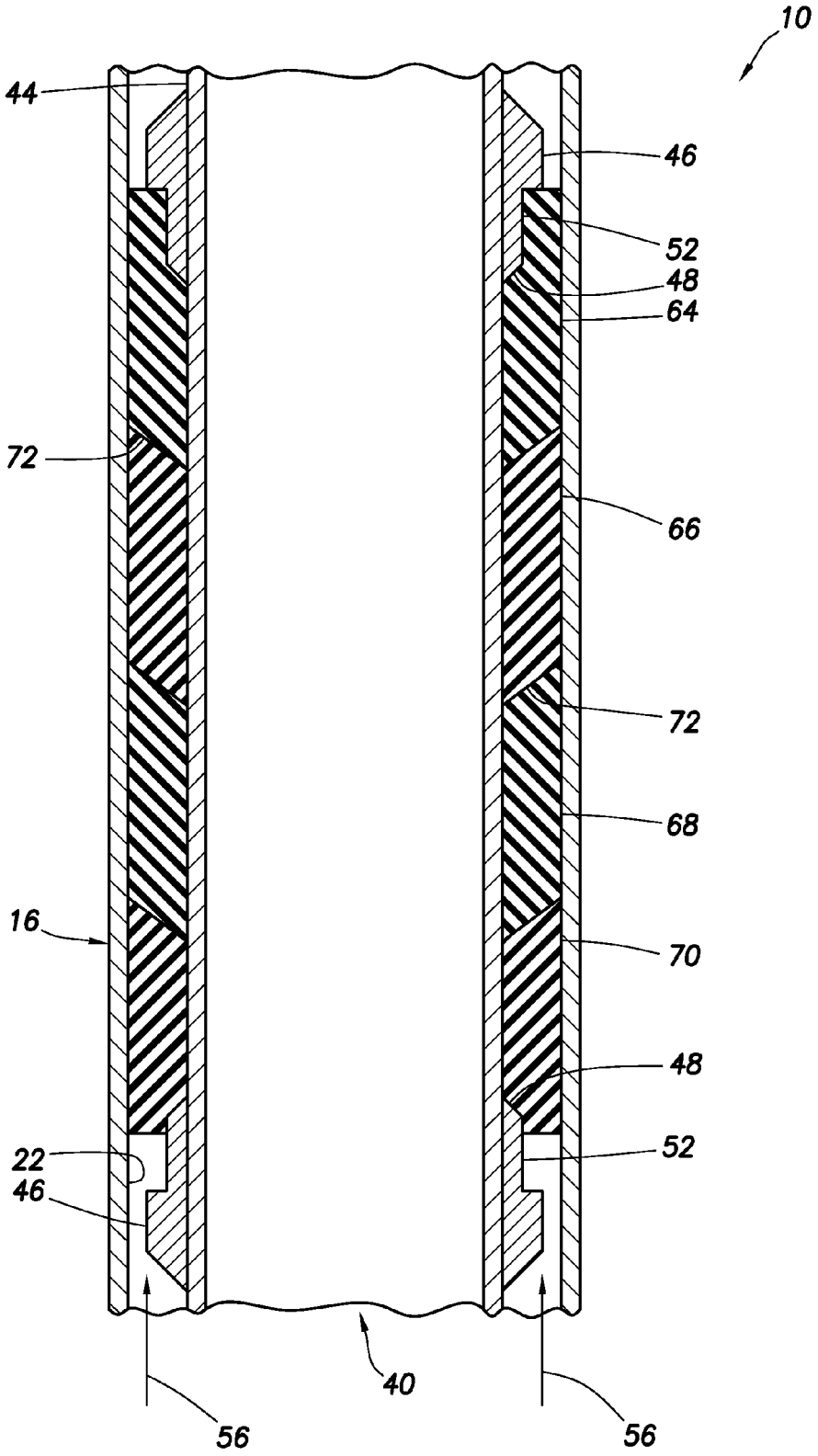

Referring additionally now to FIGS. 5A & B, the packer assembly 40 is representatively illustrated with the support rings 46 straddling the seal elements 64, 66, 68, 70. The inclined faces 72 of the seal elements 64, 66, 68, 70 are depicted as contacting each other between adjacent ones of the seal elements in FIG. 5A. In FIG. 5B, the packer assembly 40 is depicted in the well system 10 installed in the casing string 16, with the seal elements 64, 66, 68, 70 having been swollen into sealing contact with the inner surface 22 of the casing string.

It will be appreciated that, when the seal elements 64, 66, 68, 70 swell downhole, the inclined face 72 on the seal element 64 radially outwardly biases the upper end of the seal element 66 into sealing contact with the surface 22, the lower inclined face 72 on the seal element 66 radially outwardly biases the upper end of the seal element 68 into sealing contact with the surface 22, and the lower inclined face 72 on the seal element 68 radially outwardly biases the upper end of the seal element 70 into sealing contact with the surface 22. This enhances the sealing capability of the packer assembly 40, along with the enhanced sealing capability provided by the engagement between the seal elements 64, 70 and the faces 48 and surfaces 52 of the support rings 46.

Figure 6:
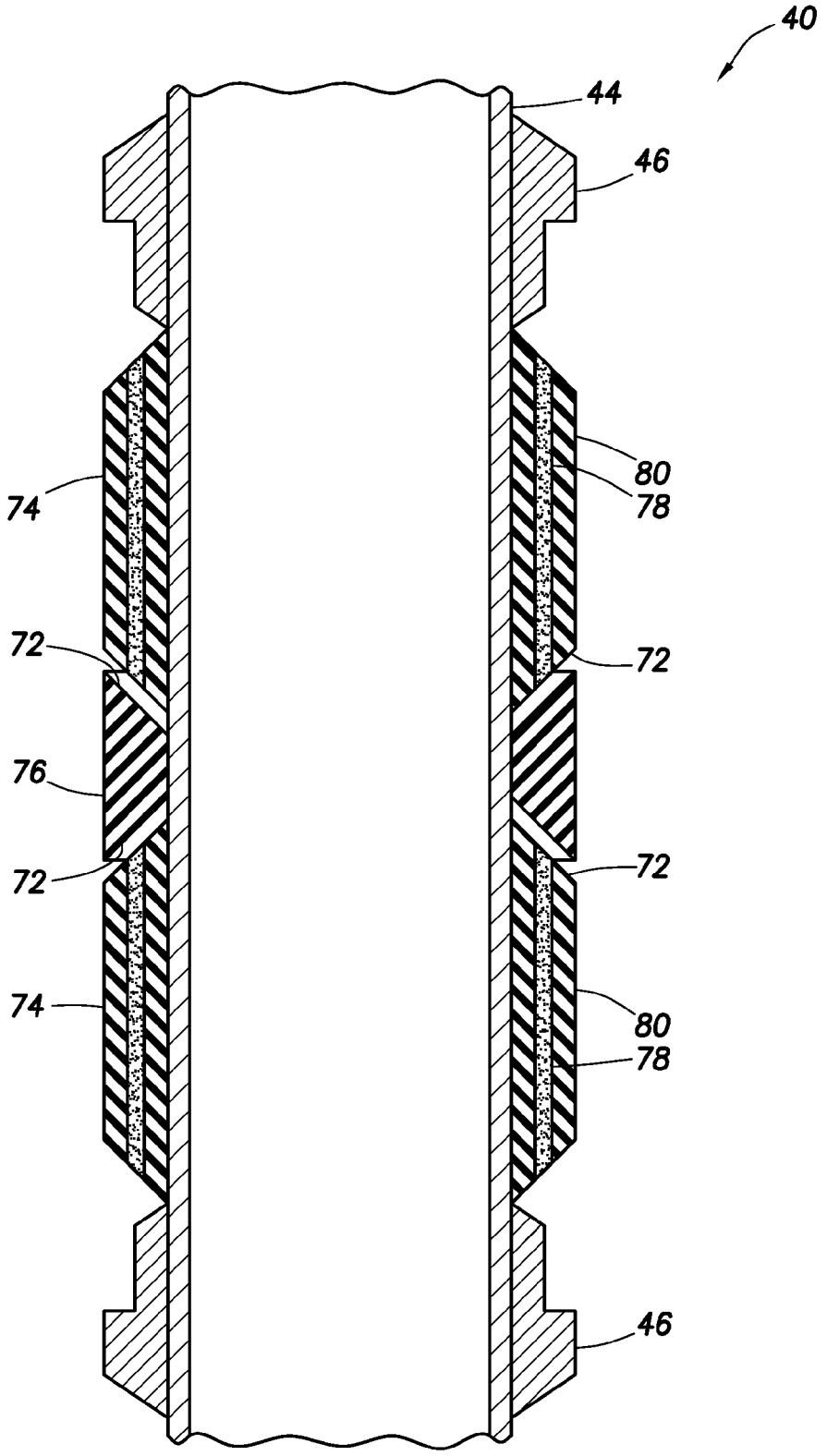
FIG. 6 is a schematic cross-sectional view of a third alternate construction of the swellable packer assembly.

Referring additionally now to FIG. 6, another alternate configuration of the packer assembly 40 is representatively illustrated. In this configuration, seal elements 74, 76 on the base pipe 44 have varying rigidity in order to more readily accomplish different functions by each seal element.

For example, the seal elements 74 could have greater rigidity to thereby more readily resist extrusion between the support rings 46 and the casing string 16 or wellbore 14 when the pressure 56 is applied in the annulus 58. Preferably, the seal elements 74 also perform a sealing function, for example to sealingly engage the surfaces 22, 24 in the well system 10.

To enhance the rigidity of the seal elements 74, a reinforcement material 78 may be provided in a seal material 80 of the seal elements. The seal material 80 is preferably a swellable seal material as described above.

The reinforcement material 78 may be mesh wire, rods made from steel, KEVLAR™ high strength polymer material, plastic, or any other reinforcement material. Various ways of providing reinforced seal elements are described in International Application serial no. PCT/US2006/035052, filed Sep. 11, 2006, entitled SWELLABLE PACKER CONSTRUCTION, and the entire disclosure of which is incorporated herein by this reference.

The seal element 76 positioned between the seal elements 74 preferably has less rigidity, so that its sealing capability against irregular surfaces is enhanced. That is, the less rigid seal element 76 is more capable of conforming to irregular surfaces when the seal element swells downhole.

Thus, the rigidities of the seal elements 74, 76 vary longitudinally along the base pipe 44 (in a direction parallel to the longitudinal axis 50), to thereby enhance the overall sealing capability of the packer assembly 40. In addition, note that the seal elements 74, 76 have inclined faces 72 formed thereon to radially outwardly bias the seal element 76 when the seal elements 74 swell downhole, and the support rings 46 radially outwardly bias the seal elements 74 in the manner described above, which features further enhance the sealing capability of the packer assembly 40.

Figure 7:
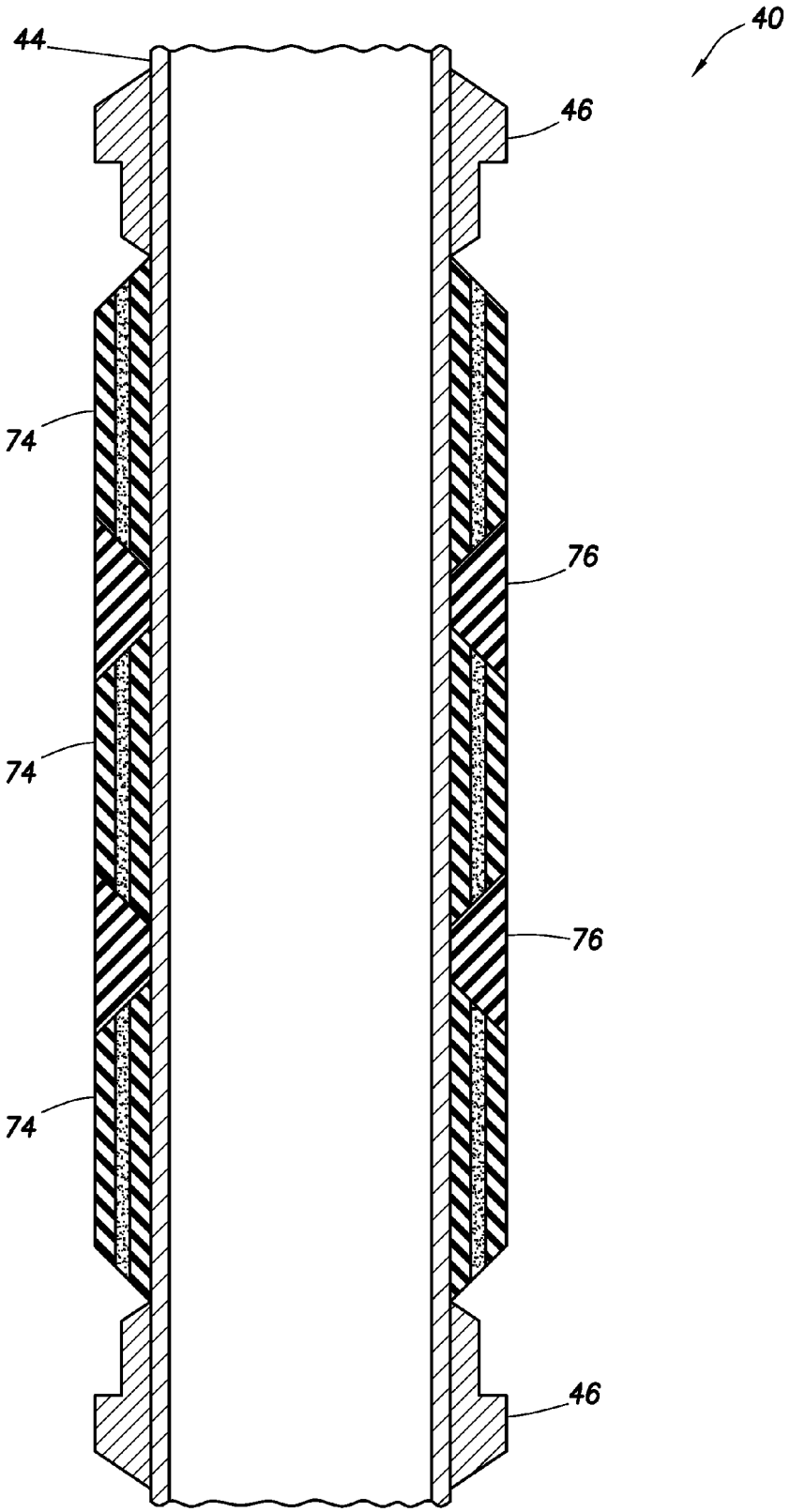
FIG. 7 is a schematic cross-sectional view of a fourth alternate construction of the swellable packer assembly.

Referring additionally now to FIG. 7, another alternate configuration of the packer assembly 40 is representatively illustrated. In this configuration, multiple seal elements 76 are installed on the base pipe 44, with the more rigid seal elements 74 straddling the seal elements 76. That is, the seal elements 74, 76 alternate along the base pipe 44.

In this manner, the seal elements 74, 76 provide varied levels of rigidity in a direction parallel to the longitudinal axis 50, with the more rigid seal elements 74 being positioned adjacent the support rings 46. However, it should be understood that any manner of varying the rigidities of the seal elements 74, 76 may be used in keeping with the principles of the invention.

Each of the seal elements 42, 64, 66, 68, 70, 74, 76 described above is preferably installed on the base pipe 44 by sliding the seal element over an end of the base pipe. That is, the end of the base pipe 44 is inserted into the seal element. However, various other installation methods may be used in keeping with the principles of the invention.

For example, the seal element could be molded onto the base pipe 44, the seal element could be wrapped helically about the base pipe, the seal element could be installed on the base pipe in a direction lateral to the longitudinal axis 50 (e.g., by providing a longitudinal slit in a side of the seal element), etc. Various methods of installing seal elements on a base pipe are described in International Application No. PCT/US2006/035052 referred to above, and in International Application no. PCT/US2006/60094, filed Oct. 20, 2006, and the entire disclosure of which is incorporated herein by this reference.

It will now be seen that the above description provides to the art a packer assembly 40 which includes multiple seal elements 42, 64, 66, 68, 70, 74, 76. Each seal element is swellable in a downhole environment, each seal element has at least one face 72 inclined relative to a longitudinal axis 50 of the packer assembly 40, and the inclined faces of adjacent seal elements contact each other.

The multiple seal elements 42, 64, 66, 68, 70, 74, 76 may be installed on a single base pipe 44. The seal elements may slide onto the base pipe from an end thereof. At least one of the seal elements may have a longitudinal slit therein which permits installation on the base pipe in a direction lateral to the longitudinal axis. At least one of the seal elements may be wrapped helically about the base pipe.

At least two support rings 32, 46 may straddle the multiple seal elements 42, 64, 66, 68, 70, 74, 76. The seal elements may be radially extendable into sealing contact with a well surface 22, 24 without decreasing a longitudinal distance between the support rings.

At least one of the support rings 46 may include a face 48 inclined relative to the longitudinal axis 50, and the support ring face may be arranged to bias an adjacent one of the seal elements 42, 64, 66, 68, 70, 74, 76 into sealing contact when the adjacent seal element swells downhole.

At least one of the support rings 46 may include a surface 52 which is radially offset relative to a surface 54 of an adjacent one of the seal elements 42, 64, 66, 68, 70, 74, 76, and the support ring surface may be arranged to bias the adjacent seal element into sealing contact when the adjacent seal element swells downhole. The support ring surface 52 may be parallel to the adjacent seal element surface 54.

The seal elements 42, 64, 66, 68, 70, 74, 76 may be radially extendable into sealing contact with a well surface 22, 24 without longitudinally compressing the seal elements.

The seal elements 42, 64, 66, 68, 70, 74, 76 may include seal elements straddling another seal element, with the second seal element being less rigid than the first seal elements. At least one of the first seal elements 74 may include a reinforcement material 78 in a seal material 80. The seal material 80 may be a swellable seal material.

The seal elements 42, 64, 66, 68, 70, 74, 76 may have varied levels of rigidity in a direction parallel to the longitudinal axis 50.

It will also be appreciated that a method of constructing a packer assembly 40 having a desired differential pressure sealing capability is provided by the above description. The method may include the steps of: providing a base pipe 44 and providing multiple seal elements 42, 64, 66, 68, 70, 74, 76.

Each of the seal elements 42, 64, 66, 68, 70, 74, 76 may be swellable in a downhole environment, and each of the seal elements may have a predetermined differential pressure sealing capability less than the desired differential pressure sealing capability of the packer assembly 40.

After the desired differential pressure sealing capability of the packer assembly 40 is determined, a selected number of the seal elements 42, 64, 66, 68, 70, 74, 76 may be installed on the base pipe 44, so that the combined predetermined differential pressure sealing capabilities of the installed seal elements is at least as great as the desired differential pressure sealing capability of the packer assembly.

The installing step may include contacting faces 72 of adjacent seal elements 42, 64, 66, 68, 70, 74, 76 with each other. The faces 72 of the adjacent seal elements may be inclined relative to a longitudinal axis 50 of the base pipe 44.

The method may include the step of swelling the seal elements 42, 64, 66, 68, 70, 74, 76 downhole, so that the seal elements sealingly contact a well surface 22, 24. The seal elements may sealingly contact the well surface without longitudinally compressing the seal elements.

The seal elements may be provided so that first seal elements 74 have greater rigidity than at least one second seal element 76. The installing step may include positioning the first seal elements 74 straddling the second seal element 76. The installing step may include varying a rigidity of the seal elements 74, 76 in a direction parallel to a longitudinal axis of the base pipe.

The installing step may include positioning support rings 32, 46 straddling the seal elements on the base pipe 44. At least one of the support rings 46 may include a face 48 inclined relative to a longitudinal axis 50 of the base pipe 44, and the support ring face may bias an adjacent one of the seal elements 42, 64, 66, 68, 70, 74, 76 into sealing contact with a well surface 22, 24 when the adjacent seal element swells downhole.

At least one of the support rings 46 may include a surface 52 which is radially offset relative to a surface 54 of an adjacent one of the seal elements 42, 64, 66, 68, 70, 74, 76. The support ring surface 52 may bias the adjacent seal element into sealing contact with a well surface 22, 24 when the adjacent seal element swells downhole. The support ring surface 52 may be parallel to the adjacent seal element surface 54.

The method may include the step of swelling the seal elements 42, 64, 66, 68, 70, 74, 76 downhole, so that the seal elements sealingly contact a well surface 22, 24, without decreasing a longitudinal distance between the support rings 32, 46.

The installing step may include sliding the seal elements 42, 64, 66, 68, 70, 74, 76 onto the base pipe 44 from an end thereof, installing at least one of the seal elements on the base pipe in a direction lateral to a longitudinal axis of the base pipe, and/or wrapping at least one of the seal elements helically about the base pipe.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of constructing a packer assembly having a desired differential pressure sealing capability, the method comprising the steps of:

providing a base pipe;

providing multiple annular seal elements which swell in response to contact with a fluid and thereby radially expand into contact with a well surface, each seal element having a predetermined differential pressure sealing capability after swelling which is less than the desired differential pressure sealing capability of the packer assembly; and after the desired differential pressure sealing capability of the packer assembly is determined, installing a selected number of the seal elements on the base pipe, so that the combined predetermined differential pressure sealing capabilities of the installed seal elements after swelling is at least as great as the desired differential pressure sealing capability of the packer assembly.

2. The method of claim 1, wherein the installing step further comprises contacting faces of adjacent seal elements with each other.

3. The method of claim 2, wherein the faces of the adjacent seal elements are inclined relative to a longitudinal axis of the base pipe.

4. The method of claim 1, further comprising the step of swelling the seal elements downhole, so that the seal elements sealingly contact a well surface.

5. The method of claim 4, wherein the seal elements sealingly contact the well surface without longitudinally compressing the seal elements.

6. The method of claim 1, wherein the seal elements providing step further comprises providing first seal elements having greater rigidity than at least one second seal element.

7. The method of claim 6, wherein the installing step further comprises positioning the first seal elements straddling the second seal element.

8. The method of claim 1, wherein the installing step further comprises varying a rigidity of the seal elements in a direction parallel to a longitudinal axis of the base pipe.

9. The method of claim 1, wherein the installing step further comprises positioning support rings straddling the seal elements on the base pipe.

10. The method of claim 9, wherein at least one of the support rings includes a face inclined relative to a longitudinal axis of the base pipe, and further comprising the step of the support ring face biasing an adjacent one of the seal elements into sealing contact with a well surface when the adjacent seal element swells downhole.

11. The method of claim 9, wherein at least one of the support rings includes a surface which is radially offset relative to a surface of an adjacent one of the seal elements, and further comprising the step of the support ring surface biasing the adjacent seal element into sealing contact with a well surface when the adjacent seal element swells downhole.

12. The method of claim 11, wherein the support ring surface is parallel to the adjacent seal element surface.

13. The method of claim 9, further comprising the step of swelling the seal elements downhole, so that the seal elements sealingly contact a well surface, without decreasing a longitudinal distance between the support rings.

14. The method of claim 1, wherein the installing step further comprises sliding the seal elements onto the base pipe from an end thereof.

15. The method of claim 1, wherein the installing step further comprises installing at least one of the seal elements on the base pipe in a direction lateral to a longitudinal axis of the base pipe.

16. The method of claim 1, wherein the installing step further comprises wrapping at least one of the seal elements helically about the base pipe.

* * * * *